US008342355B2

(12) United States Patent
Goade

(10) Patent No.: US 8,342,355 B2
(45) Date of Patent: Jan. 1, 2013

(54) CONTROLLED FLOW DRINKING ADAPTER AND KIT

(76) Inventor: Ann M. Goade, Stuart, FL (US)

( * ) Notice: Subject to any disclaimer, the term of this patent is extended or adjusted under 35 U.S.C. 154(b) by 85 days.

(21) Appl. No.: 12/811,173

(22) PCT Filed: Jan. 23, 2009

(86) PCT No.: PCT/US2009/031761

§ 371 (c)(1),
(2), (4) Date: Jun. 29, 2010

(87) PCT Pub. No.: WO2009/102541

PCT Pub. Date: Aug. 20, 2009

(65) Prior Publication Data

US 2010/0294788 A1 Nov. 25, 2010

Related U.S. Application Data

(60) Provisional application No. 61/027,859, filed on Feb. 12, 2008.

(51) Int. Cl.

| | |
|---|---|
| ***B65D 41/32*** | (2006.01) |
| ***B65D 41/34*** | (2006.01) |
| ***B65D 47/10*** | (2006.01) |
| ***B65D 17/40*** | (2006.01) |

(52) U.S. Cl. ..... 220/287; 215/250; 215/253; 215/256; 220/229; 220/266; 220/276; 220/309.1; 220/717; 426/122

(58) Field of Classification Search ..... 220/229, 220/309.1, 717, 266, 276, 287; 426/122; 215/250, 253, 256

See application file for complete search history.

(56) References Cited

U.S. PATENT DOCUMENTS

| | | | | |
|---|---|---|---|---|
| 3,045,879 | A * | 7/1962 | Daly | 222/482 |
| 4,121,731 | A * | 10/1978 | Okerstrum | 220/715 |
| 4,790,444 | A | 12/1988 | Terzi | |
| 5,050,758 | A * | 9/1991 | Freeman et al. | 220/714 |
| D345,673 | S | 4/1994 | Dark | |
| 5,392,949 | A * | 2/1995 | McKenna | 220/712 |
| D372,639 | S | 8/1996 | Kristinik | |
| 5,651,471 | A | 7/1997 | Green | |
| D387,621 | S | 12/1997 | Sullivan et al. | |
| 5,839,596 | A | 11/1998 | Zahn et al. | |
| 5,873,478 | A | 2/1999 | Sullivan et al. | |
| 5,890,620 | A | 4/1999 | Belcastro | |
| D418,364 | S | 1/2000 | Demore | |
| 6,112,926 | A | 9/2000 | Fishman | |

(Continued)

FOREIGN PATENT DOCUMENTS

GB 2421896 A * 7/2006

(Continued)

*Primary Examiner* — Anthony Stashick
*Assistant Examiner* — Jennifer Castriotta
(74) *Attorney, Agent, or Firm* — Duane Morris LLP; J. Rodman Steele, Jr.; Gregory M. Lefkowitz

(57) ABSTRACT

An on-demand drinking adapter for use with a beverage container is disclosed. The adapter includes a base with an upper surface and generally cylindrical sides which extend below the upper surface. The cylindrical sides are adapted for temporarily fastening the adapter to a mouth of a beverage container. The adapter also includes a spout with a vertically extending surface, a second surface, and an on-demand drinking aperture. The spout extends above the upper surface and the vertically extending surface is curved and coextensive with a portion of the cylindrical sides.

20 Claims, 21 Drawing Sheets

U.S. PATENT DOCUMENTS

| | | | |
|---|---|---|---|
| RE37,016 | E | 1/2001 | Morano |
| 6,279,773 | B1 | 8/2001 | Kiyota |
| D448,297 | S | 9/2001 | Sindermann |
| 6,290,090 | B1 | 9/2001 | Essebaggers |
| 6,478,179 | B1 | 11/2002 | Alexander |
| 6,508,379 | B1 | 1/2003 | Van De Pol-Klein Nagelvoort et al. |
| 6,523,711 | B1 | 2/2003 | Hughes et al. |
| 6,722,513 | B1 | 4/2004 | Flood et al. |
| 6,783,020 | B2 | 8/2004 | Featherston et al. |
| 6,880,713 | B2 | 4/2005 | Holley, Jr. |
| 6,923,337 | B2 | 8/2005 | Hession et al. |
| 6,942,121 | B1 | 9/2005 | Northup et al. |
| 6,991,122 | B2 | 1/2006 | Holley, Jr. |
| 6,994,225 | B2 | 2/2006 | Hakim |
| 7,014,066 | B2 | 3/2006 | Jeter |
| 7,021,481 | B2 | 4/2006 | St. Germain et al. |
| 7,150,370 | B2 | 12/2006 | Pyun |
| 7,182,216 | B2 * | 2/2007 | Reinoso ..... 220/713 |
| D552,926 | S * | 10/2007 | Yelland ..... D7/392.1 |
| 7,275,652 | B2 | 10/2007 | Morris et al. |
| 7,562,789 | B2 * | 7/2009 | Randolph et al. ..... 220/710.5 |
| 2003/0218015 | A1 * | 11/2003 | Randolph et al. ..... 220/212.5 |
| 2004/0000551 | A1 | 1/2004 | Flink et al. |
| 2004/0124170 | A1 * | 7/2004 | Sherrod ..... 215/319 |
| 2005/0092760 | A1 | 5/2005 | Westerhold |
| 2005/0178775 | A1 * | 8/2005 | Burke et al. ..... 220/710.5 |
| 2006/0273059 | A1 * | 12/2006 | Mendenhall et al. ..... 215/11.1 |
| 2007/0164025 | A1 | 7/2007 | McCandlish et al. |
| 2007/0210093 | A1 * | 9/2007 | Pinelli ..... 220/715 |
| 2007/0221604 | A1 * | 9/2007 | Hakim ..... 215/11.4 |

FOREIGN PATENT DOCUMENTS

| | | |
|---|---|---|
| KR | 1999-0041055 | 12/1999 |
| WO | 92/14675 | 9/1992 |
| WO | 02/28344 | 4/2002 |

* cited by examiner

CONTROLLED FLOW DRINKING ADAPTER AND KIT

CROSS-REFERENCE TO RELATED APPLICATIONS

This application is a §371 national stage entry of International Application No. PCT/US2009/031761, filed Jan. 23, 2009, which claims priority to U.S. Provisional Application No. 61/027,859, filed Feb. 12, 2008, both of which are hereby incorporated herein by reference in their entirety.

TECHNICAL FIELD

The invention relates to a controlled flow drinking apparatus that can be attached to beverage bottles.

BACKGROUND

Stores, such as convenience stores and grocery stores, sell a broad range of bottled beverages. While the majority of the population can conveniently drink from these beverage containers without spilling them, there are segments of the population that cannot without a substantial risk of spills. For example, toddlers want to drink from beverage bottles just like their parents and older siblings. Similarly, individuals that are infirm or with certain disabilities are also susceptible to spills when consuming from such beverage containers. Thus, there is a need for a device that may be used to reduce the risk of spills for these segments of the population.

SUMMARY OF THE INVENTION

The present invention is directed to an on-demand drinking adapter for use with a commercially sold beverage container. The drinking adapter can include a base with an upper surface and generally cylindrical sides extending below the upper surface. The generally cylindrical sides can be adapted for temporarily fastening the drinking adapter to the mouth of a beverage container. The drinking adapter can also include a spout having a first vertically extending surface, a second surface, and an on-demand drinking aperture, where the spout extends above the upper surface. The first vertically extending surface can be curved and coextensive with a portion of the cylindrical sides. The spout can include a third surface that defines an uppermost portion of the spout, where the on-demand drinking aperture is disposed in the third surface.

The entire perimeter of the second surface can be defined by the intersection of the second surface with the first vertically extending surface and the generally cylindrical side. The entire perimeter of the second surface can be defined by the intersection of the second surface with the first vertically extending surface, the generally cylindrical side, and the on-demand drinking aperture. The profile of the intersection of the second surface and the first vertically extending surface can be curvilinear. The profile of the intersection of the second surface and the upper surface can be curvilinear.

The on-demand drinking aperture can be a slot having a width selected to minimize leakage of fluid from a beverage container when said on-demand drinking adapter is fastened to a beverage container. The second surface can include the on-demand drinking aperture. The on-demand drinking aperture can be defined by the edges of the first vertically extending surface and the second surface. The on-demand drinking aperture can include a valve for controlling fluid flow.

The generally cylindrical sides can be conical, with the pitch of the cone selected such that the drinking adapter can be temporarily fastened to beverage containers having mouths of various sizes. The generally cylindrical sides can be terraced, wherein each level of the terrace can be used to fasten the drinking adapter to a different sized bottle mouth.

The drinking adapter can include a handle extending from the generally cylindrical sides. The handle can be an elongated solid with a T-shaped cross-section, wherein a primary axis of the elongated solid is oriented generally vertically. The handle can be located on a side of the generally cylindrical side opposite the on-demand drinking aperture.

The drinking adapter can have two handles extending from the generally cylindrical sides, wherein each handle comprises an elongated solid with a T-shaped cross-section, wherein a primary axis of each elongated solid is oriented generally vertically.

The drinking adapter can include a plug for the on-demand drinking aperture, and the plug can be an integral part of the drinking adapter. The plug can include a tether portion and a stopper portion designed to fit the dimensions of the drinking aperture, where the first end of the tether portion is connected to the base and the stopper portion is connected to the opposite end of the tether portion.

The first vertically extending surface of the spout can be coextensive with at least three-quarters of a perimeter of the generally cylindrical sides. The first vertically extending surface can be coextensive with the entire perimeter of the generally cylindrical sides and the upper surface and the second surface can be the same.

The generally cylindrical side of the drinking adapter can be perforated and the drinking adapter can be designed such that, once attached to a beverage container, the drinking adapter will remain on the beverage container until the generally cylindrical side is torn using the perforations. The generally cylindrical side can include a plurality of threading sections separated by perforations, each threading section having a different threading pattern.

The drinking adapter can also include a terrace level comprising a second generally cylindrical side and a terrace rim, where the terrace rim connects a lower end of the generally cylindrical side to an upper end of the second generally cylindrical side. The second generally cylindrical side can have a smaller diameter than the diameter of the generally cylindrical side. The interface between the terrace rim and the generally cylindrical side can be perforated.

The second generally cylindrical side can have a larger diameter than a diameter of the generally cylindrical side. The interface between the terrace rim and the generally cylindrical side can be perforated, or the interface between the terrace rim and the second generally cylindrical side can be perforated, or both.

In some embodiments, the generally cylindrical side can include a plurality of threading sections separated by perforations, where each threading section has a different threading pattern. The second generally cylindrical side can include a plurality of threading sections separated by perforations, wherein each threading section has a different threading pattern. In some embodiments both the generally cylindrical side and the second generally cylindrical side can include a plurality of threading sections separated by perforations.

These and other embodiments are described in more detail below.

BRIEF DESCRIPTION OF THE DRAWINGS

A fuller understanding of the present invention and the features and benefits thereof will be obtained upon review of the following detailed description together with the accompanying drawings, in which.

DETAILED DESCRIPTION

Figure 1A:
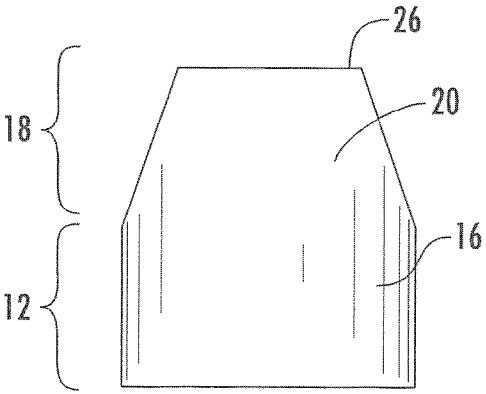
FIG. 1(*a*) is a front view of a drinking adapter of the present invention; (*b*) is a side view of a drinking adapter of the present invention; and (*c*) is a top view of a drinking adapter of the present invention.

The present invention is directed to an on-demand drinking adapter 10 for use with a beverage container (A). The drinking adapter can include a base 12 with an upper surface 14 and generally cylindrical sides 16 extending below the upper surface 14. The generally cylindrical sides 16 can be adapted for temporarily fastening the drinking adapter to the mouth of a beverage container (A). The drinking adapter 10 can also include a spout 18 having a first vertically extending surface 20, a second surface 22, and an on-demand drinking aperture 24, where the spout 18 extends above the upper surface 14. The first vertically extending surface 20 can be curved and coextensive with a portion of the cylindrical sides 16. The spout 18 can include a third surface 26 that defines an uppermost portion of the spout 18, wherein the third surface 26 comprises the on-demand drinking aperture 24.

The drinking adapters may find utility to parents whose child wants to drink from a big-girl beverage container. The drinking adapters may be disposable so that a parent can carry drinking adapters of various sizes with them and use them on any commercially purchased beverage bottle without worrying that their children will spill the beverage causing a big mess.

Similarly, the drinking adapters may be used by individuals providing care to the elderly or individuals with certain diseases or disabilities. As the American population ages, more and more children find it necessary to provide in-home care to their aging parents. In such an environment, the drinking adapters may be used to minimize spills while having the convenience of an adapter that can fit most any size of commercial beverage container.

These drinking adapters eliminate the need for "sippy-cups," which are both bulky and expensive. Due to their bulk, "sippy-cups" cannot be easily carried in a purse or other small bag. In contrast, the drinking adapters disclosed herein can easily be transported in a purse or similar storage bag, while leaving ample room for other necessary items. In addition, the drinking adapters can be disposed of, or recycled, once they have been used.

Figure 2A:
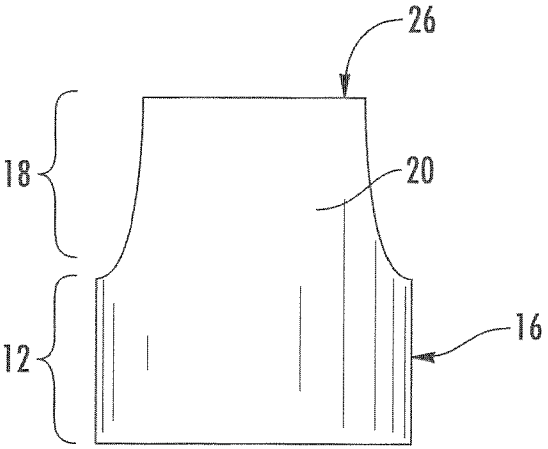
FIG. 2(*a*) is a front view of a drinking adapter where the intersection of the second surface and the first vertically extending surface is curved and where the upper surface and the second surface are the same; (*b*) is a side view of the drinking adapter; and (*c*) is a top view of the drinking adapter.
Figure 2C:
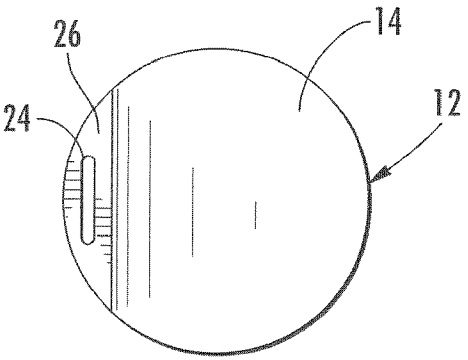
Figure 2B:
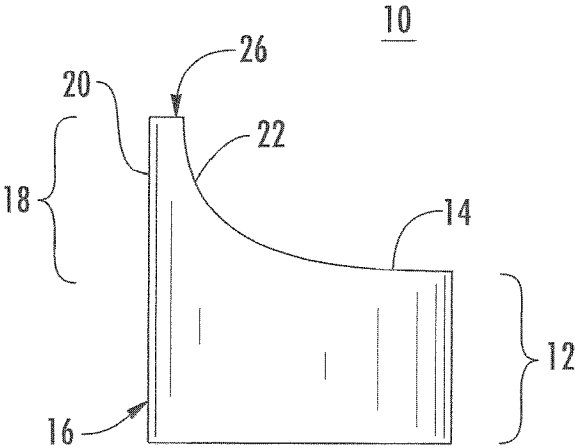
Figure 9A:
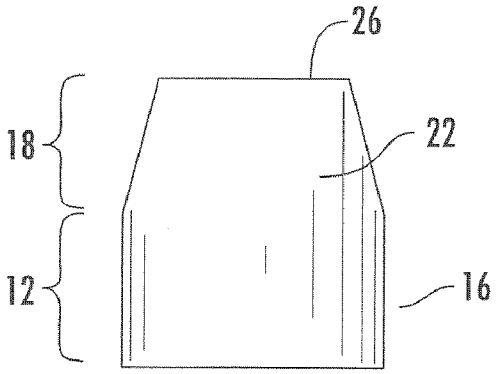
FIG. 9(*a*) is a front view of a drinking adapter with a curved intersection between the upper surface of the base and the second surface of the spout; (*b*) is a side view of the drinking adapter; and (*c*) is a top view of the drinking adapter.
Figure 9C:
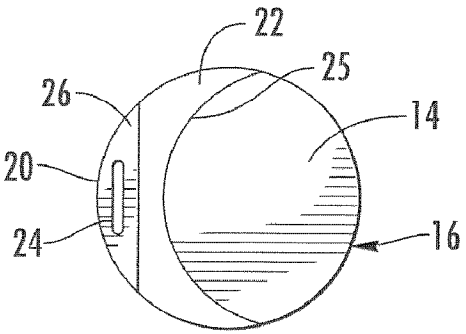
Figure 9B:
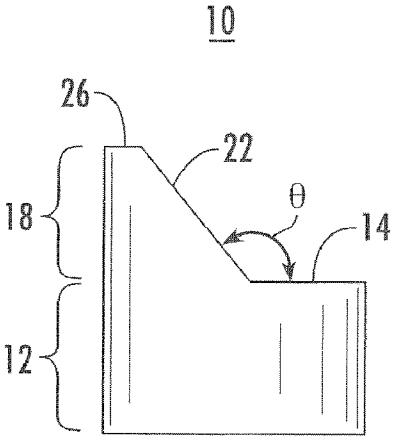

As shown in FIG. 2, the entire perimeter of the second surface 22 can be defined by the intersection of the second surface 22 with the first vertically extending surface 20 and the generally cylindrical side 16. Although not shown, the entire perimeter of the second surface 22 can be defined by the intersection of the second surface 22 with the first vertically extending surface 20, the generally cylindrical side 16, and the on-demand drinking aperture 24. The profile of the intersection of the second surface 22 and the first vertically extending surface 20 can be curvilinear or linear, as shown in FIGS. 2(*b*) and 1(*b*), respectively. The profile of the intersection 25 of the second surface 22 and the upper surface 14 can be curvilinear or linear, as shown in FIGS. 9(*c*) and 1(*c*), respectively.

Figure 1C:
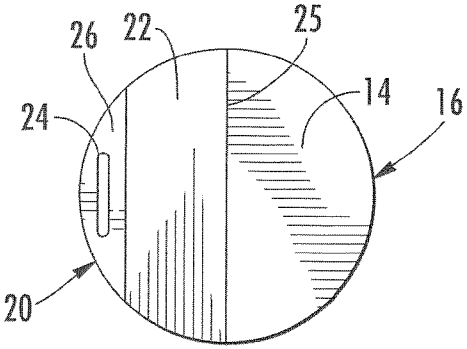
Figure 1B:
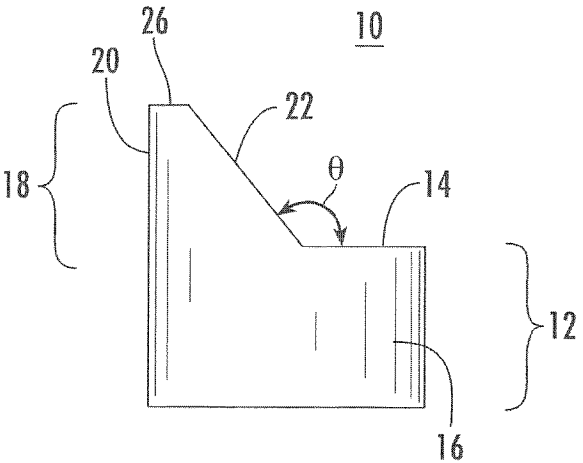

As shown in FIG. 1, the angle (θ) between the upper surface 14 and the second surface 22 can be anywhere between about 90 degrees and about 180 degrees, or between about 90 degrees and about 135 degrees. This can provide a substantial amount of flexibility with respect to the shape of the spout.

Figure 3A:
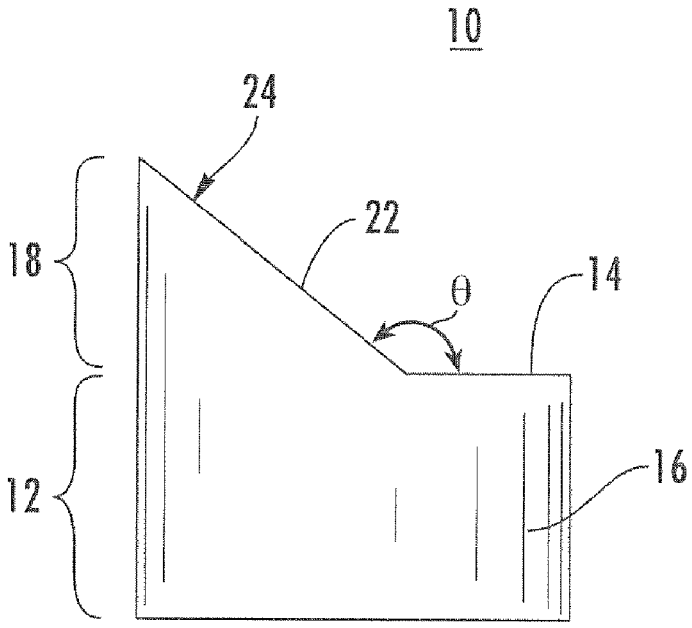
FIG. 3(*a*) is a side view of a drinking adapter where the on-demand drinking aperture is part of the second surface of the spout; (*b*) is a top view of the drinking adapter.
Figure 3B:
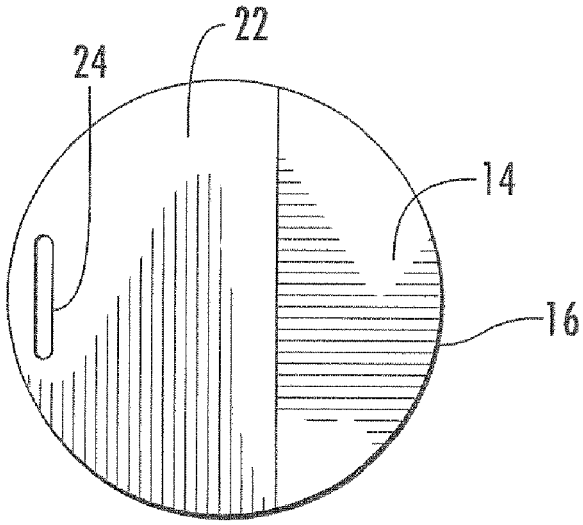
Figure 10A:
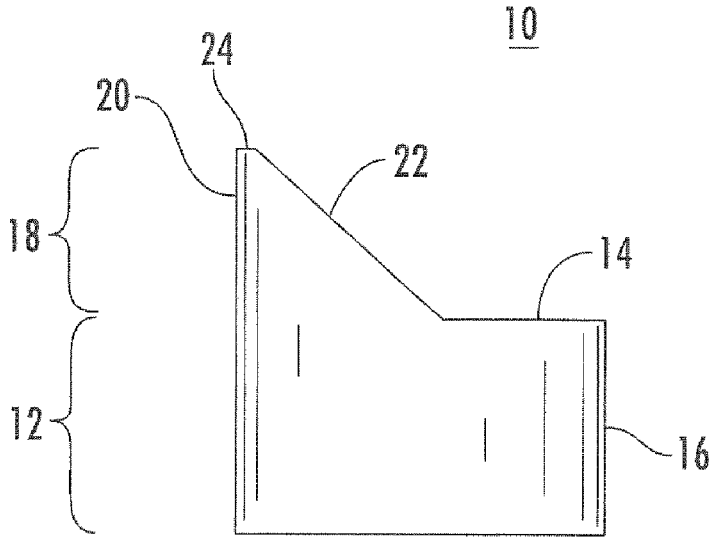
FIG. 10(*a*) is a side view of a drinking adapter where the on-demand drinking aperture is defined by the edges of the first vertically extending surface and the second surface; and (*b*) is a top view of the drinking adapter.
Figure 10B:
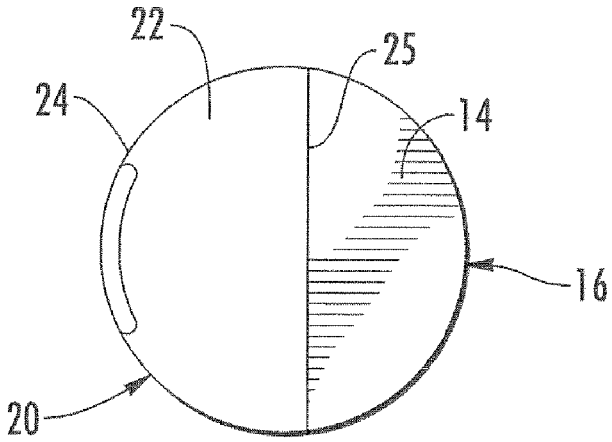

The on-demand drinking aperture 24 can be a slot having a width selected to allow an individual to drink fluid using suction, while also minimizing leakage of fluid from a beverage container (A) when the on-demand drinking adapter 10 is fastened to a beverage container (A). As shown in FIG. 3(*b*), the second surface 22 can include the on-demand drinking aperture 24. As shown in FIG. 10, the on-demand drinking aperture 24 can be defined by the edges of the first vertically extending surface 20 and the second surface 22. The on-demand drinking aperture 24 can include a valve for controlling fluid flow. The on-demand drinking apparatus 10 can be valveless.

Where the on-demand drinking aperture 24 is valveless, the on-demand drinking aperture 24 can be dimensioned such that surface tension can prevent leakage when the bottle to which the drinking adapter is attached is placed on its side. For elongated on-demand drinking apertures 24, this can require that the apertures be narrow. In addition, the size of the aperture can be dependent on the diameter of the bottle to which the drinking adapter is intended to be attached. Larger diameter bottles may require smaller, e.g., narrower, on-demand drinking apertures.

Where the first vertically extending surface 20 is coextensive with a portion of the generally cylindrical sides 16, the spout 18 can be offset from the center of the drinking adapter 10. As a result, when the drinking adapter 10 is attached to a beverage container (A) that is more than one half full, the off-set spout 18 will fill with fluid. As a result of gravity, a beverage container (A) with the drinking adapter 10 attached will tend to come to rest with the spout side 18 of the drinking adapter 10 toward the ground. Based on this known orientation, the on-demand drinking aperture 24 may be located on the spout 18 in an orientation that will minimize leakage. For example, the on-demand drinking aperture 24 may be located on a face of the second surface 22, as shown in FIG. 3. This orientation will result in the on-demand drinking aperture 24 facing up, when the beverage container (A) comes to rest with the spout side 18 of the drinking adapter 10 toward the ground.

Figure 20:
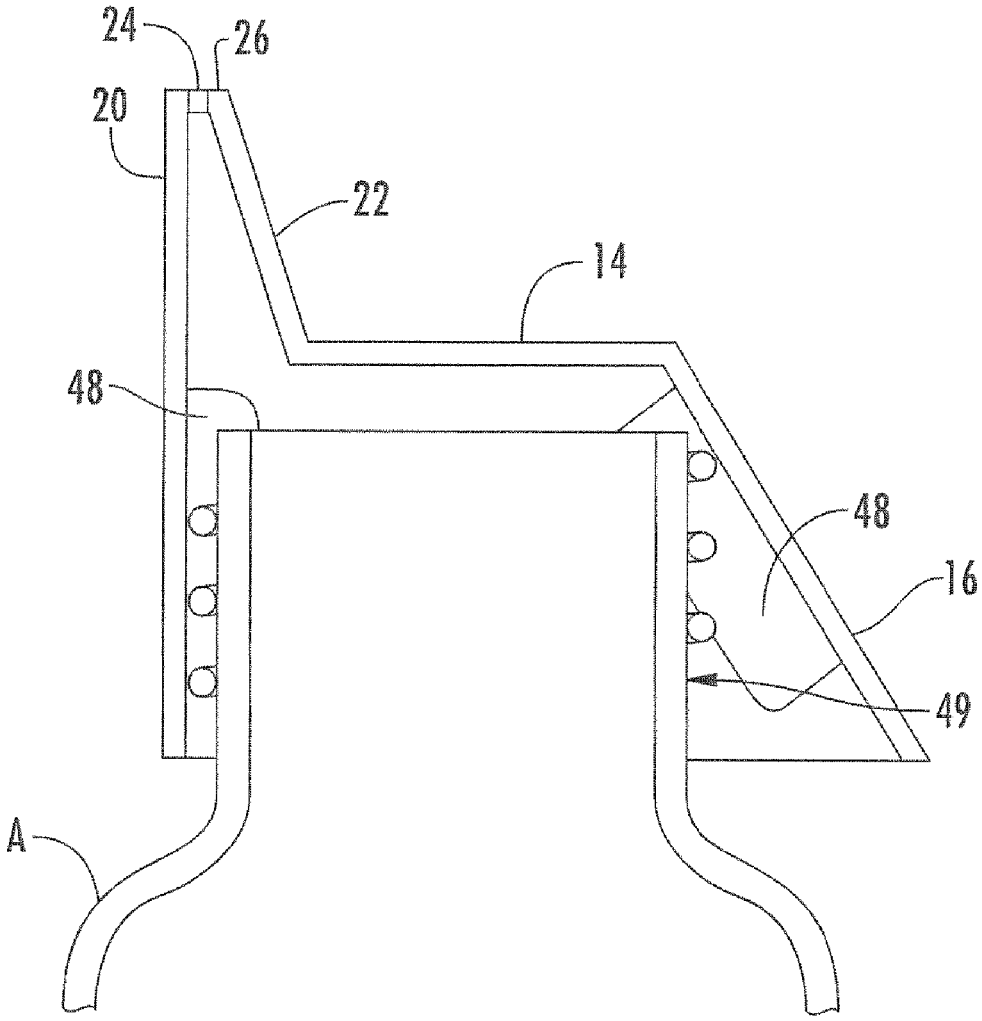
FIG. 20 is a cross-sectional view of the drinking adapter of FIG. 19 taken along cut line 20-20.

The generally cylindrical sides 16 can be sized to match the diameter of the mouth of a commercially available beverage container (A). In some embodiments, such as that shown in FIG. 15, the interior of the generally cylindrical sides 16 can include threading with a pitch known to match commercially available beverage containers (A) having the designed mouth diameter. In other embodiments, such as that shown in FIG. 20, the interior of the generally cylindrical sides 16 can be lined with an elastomeric material 48, such as a rubber or foam, which can create a leak-tight seal and conform to a variety of known threading pitches on bottles having the designed mouth diameter. Exemplary rubbers include, but are not limited to, natural rubber, ethylene propylene polymers, ethylene propylene diene polymers, polyeurethanes, styrene-butadiene polymers, nitrile rubber, butyl rubber, silicone rubber, fluoroelastomers, ethylene-vinyl acetate elastomers, copolymers thereof, and combinations thereof.

Where elastomers are used, they can be incorporated part of a compression sealing material 48. As shown in FIG. 20, the drinking adapter 10 can be temporarily attached to a beverage container (A) when a seal is created between the compression sealing material 48 and the exterior surface 49 of the outside of the bottle mouth. Thus, the compression sealing material 48 can be selected and plasticizers and other additives can be added, in order to increase the coefficient of friction between the beverage container (A), which will generally be plastic or glass, and the elastomer. In addition, the elastomers can be selected and plasticizers and other additives added such that they exert a sufficient force following compression to form a water-tight seal.

The thickness of the compression seal material 48 can be selected to create a water-tight seal on bottle mouths of various sizes. For example, as is evident from FIG. 20, the thickness of the compression seal material 48 controls how many thread rows are involved in the seal. In general, embodiments relying on the compression seal material can be screwed onto the mouth of the beverage container (A); however, they may also be pressed onto the mouth of the beverage container (A).

Figure 11A:
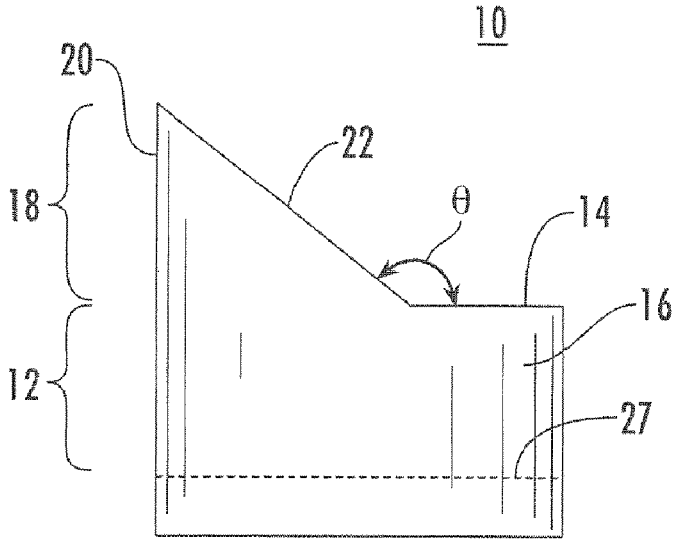
FIG. 11(*a*) is a side view of a drinking adapter with perforations forming a horizontal ring along the base of the generally vertical side; and (*b*) is a top view of the drinking adapter.
Figure 11B:
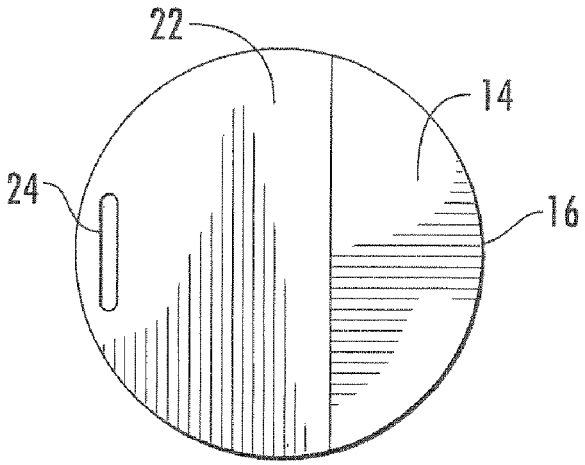
Figure 12A:
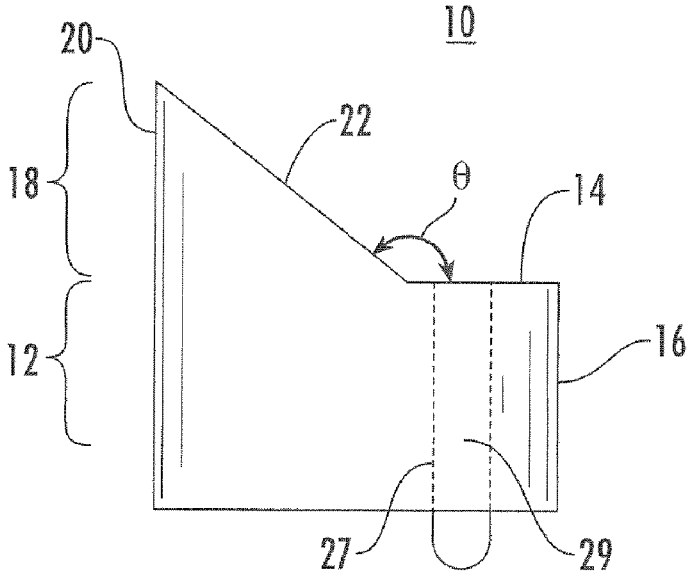
FIG. 12(*a*) is a side view of a drinking adapter with a perforated vertical strip with a tap running the vertical length of the generally vertical side; and (*b*) is a top view of the drinking adapter.
Figure 12B:
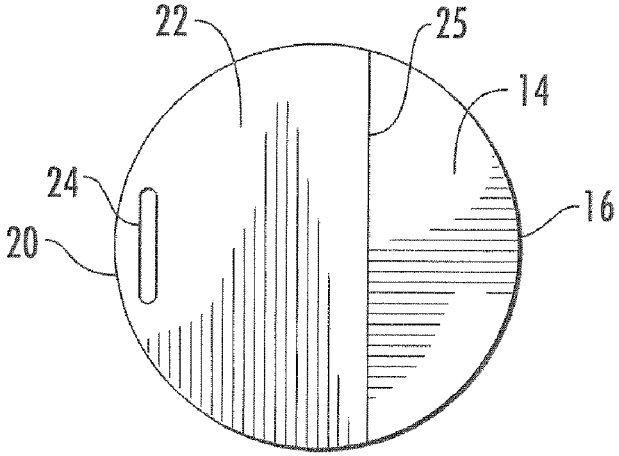

In other embodiments of the invention, such as those shown in FIGS. 11 & 12, the generally cylindrical sides 16 of the drinking adapter 10 can be designed such that the drinking adapter 10 attaches to a beverage container (A) such that the drinking adapter 10 must be damaged in order to remove it. The drinking adapter 10 may screw on, but require damaging the drinking adapter 10 in order to remove the drinking adapter 10. The drinking adapter 10 can be made of plastic and can include perforations 27 in order to simplify tearing of the adapter for removal of the drinking adapter 10. For example, the perforations 27 can be horizontal ring along the base of the generally vertical sides 16, as shown in FIG. 11, or a vertical strip 29 with a tap running the vertical length of the generally vertical sides 16, as shown in FIG. 12. Such embodiments can be used to "child-proof" the drinking adapter 10 so that the parent or caregiver can remove the drinking adapter 10, but the child or other person in need of the drinking adapter cannot easily remove the drinking adapter 10.

Figure 19A:
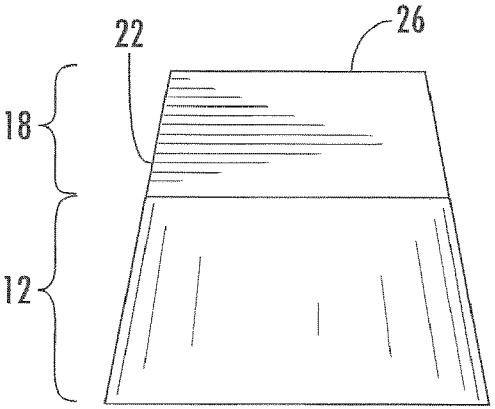
FIG. 19(*a*) is a front view of a drinking adapter where the generally cylindrical sides are conical and the spout is offset to a side of the base of the drinking adapter; (*b*) is a side view of the drinking adapter; and (*c*) is a top view of the drinking adapter.
Figure 19C:
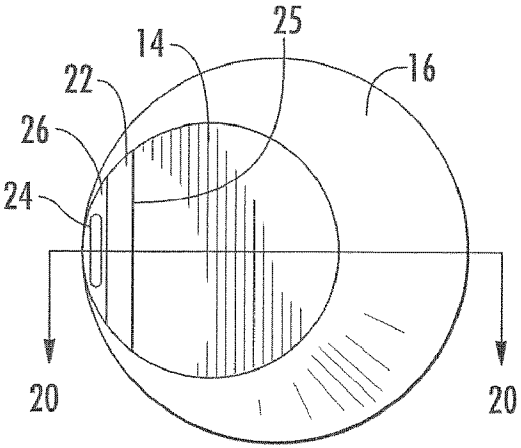
Figure 19B:
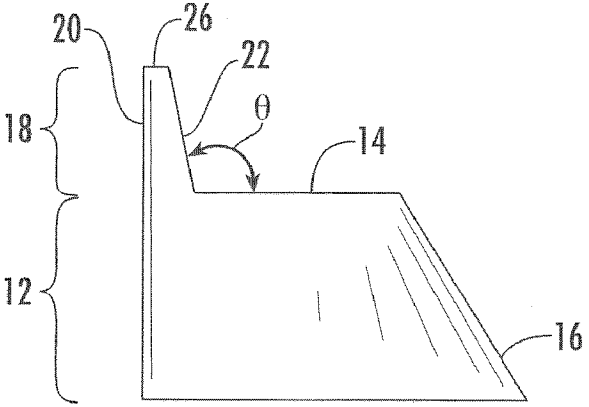

As shown in FIGS. 19-21, the generally cylindrical sides 16 can be conical, with the pitch of the cone selected such that a single drinking adapter 10 can be temporarily fastened to beverage containers (A) having mouths of various sizes. As shown in FIG. 20, the cylindrical sides, in combination with a compression sealing material 48 can be used to form a liquid tight seal between the drinking adapter 10 and a beverage container (A). In these embodiments, the conical shape can be symmetrical, as in FIG. 21, or asymmetrical, as in FIG. 19. Similarly, the spout 18 can be off-set to one side of the base 12, as in FIG. 19, centered in the middle of the base 12, as in FIG. 21, or somewhere in between.

Figure 13A:
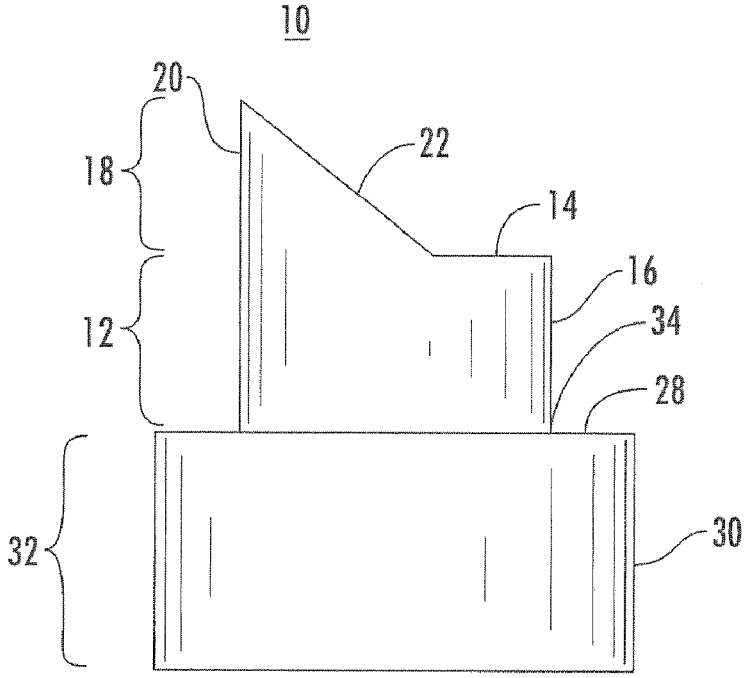
FIG. 13(*a*) is a side view of a drinking adapter with a terraced attachment feature for attaching the drinking adapter to bottle mouths of different diameters, and (*b*) is a top view of the drinking adapter.
Figure 13B:
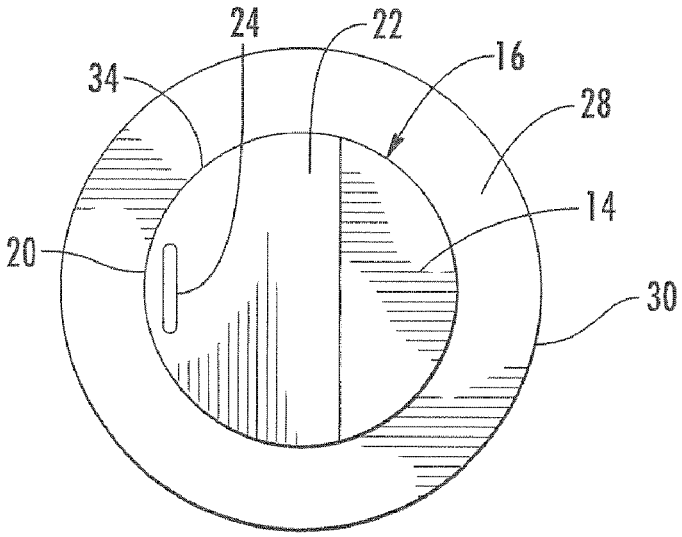
Figure 14A:
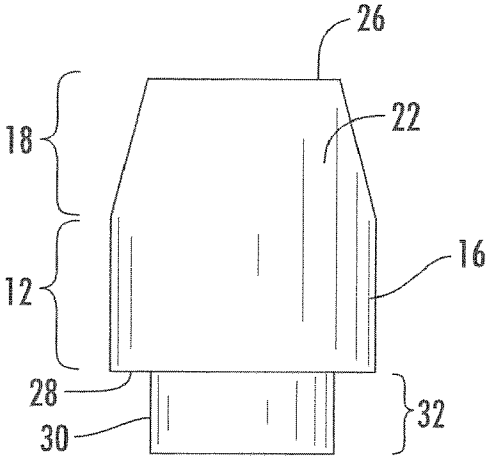
FIG. 14(*a*) is a front view of a drinking adapter with an inverted terraced attachment feature for attaching the drinking adapter to bottle mouths of different diameters; (*b*) is a side view of the drinking adapter; and (*c*) is a top view of the drinking adapter.
Figure 14C:
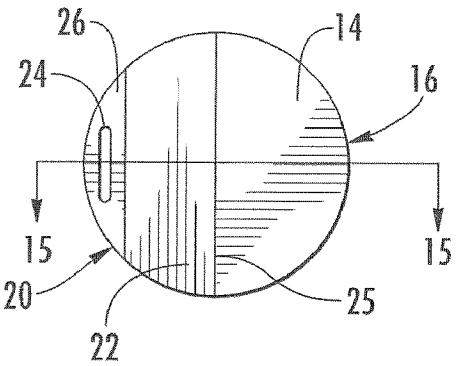
Figure 14B:
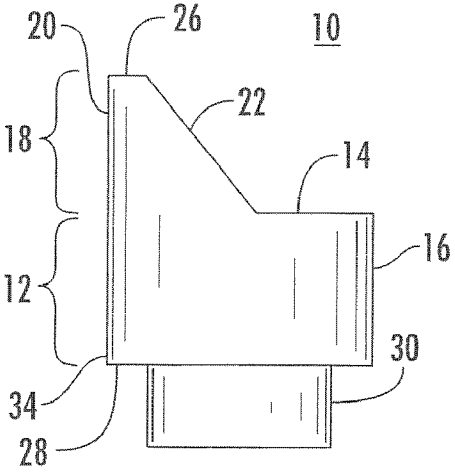
Figure 15:
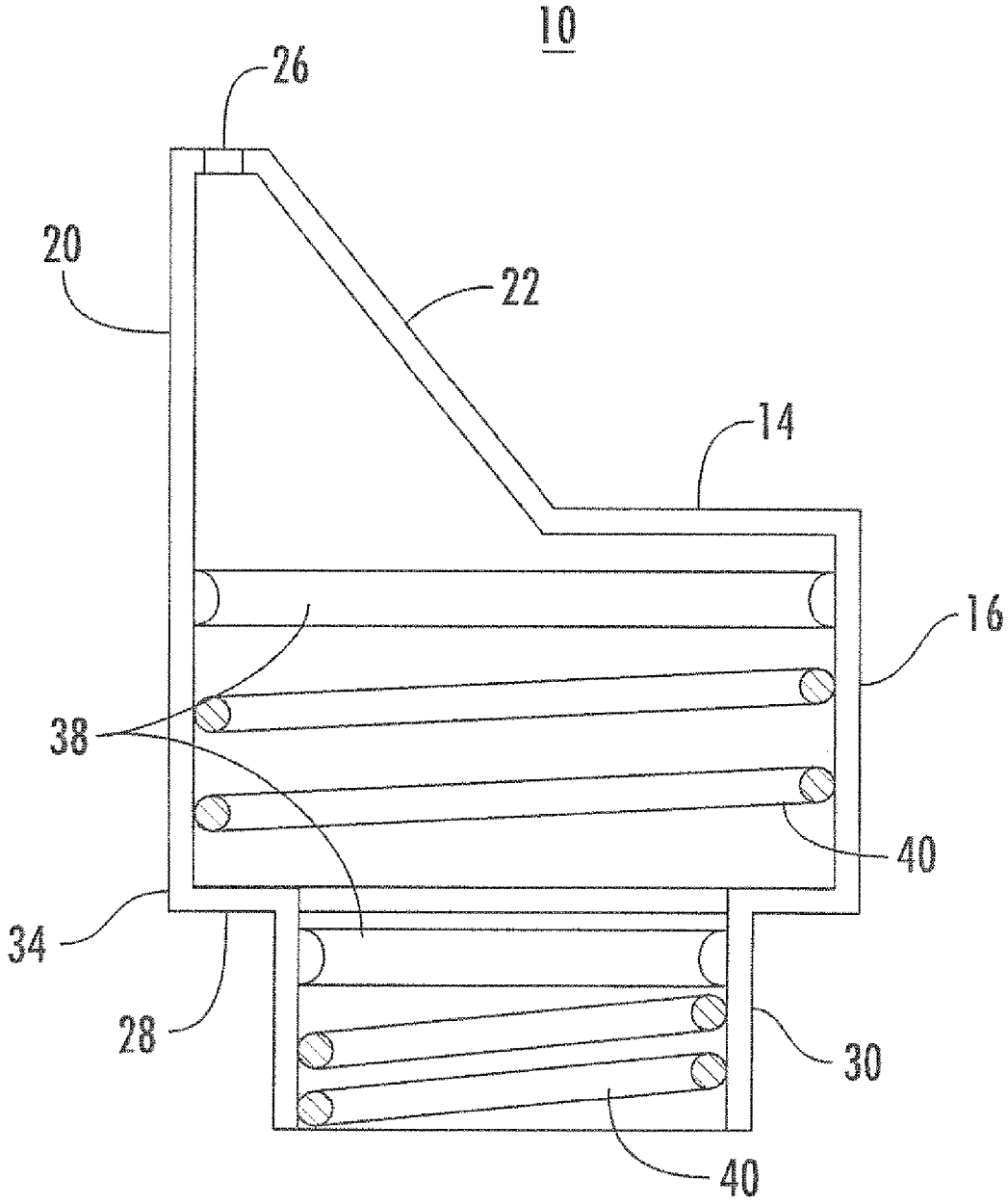
FIG. 15 is a cross-sectional view of the drinking adapter of FIG. 14 taken along cut line 14-14 of FIG. 14(*c*).

In other embodiments, such as those shown in FIGS. 13-15, the generally cylindrical sides 16 can include one or more terrace levels 32, where each terrace level 32 can include a terrace rim 28 and an additional generally cylindrical side 30. Each additional generally cylindrical side 30 in the terraced embodiment can be used to fasten the drinking adapter 10 to bottle mouths of different diameters. Such an embodiment is shown in FIG. 13. In such an embodiment, each generally cylindrical side 16, 30 can be threaded so that it fits the mouth of a bottle of a different diameter and the terrace rim 28 serves to create a leak-tight seal with the rim of each bottle mouth. The height of the generally cylindrical sides 16, 30 should be minimized in order to ensure that the generally cylindrical sides 16, 30 for attachment to large diameter bottle mouths do not interfere with attachment to a small diameter bottle mouth.

In another embodiment, the drinking adapter can have an inverted terrace structure, as shown in FIG. 14, having one or more terrace levels 32 that include a terrace rim 28 and an additional generally cylindrical side 30. In such an embodiment, the interior of each generally cylindrical sides 16, 30 can be threaded 40 so that each generally cylindrical side 16, 30 fits the mouth of a bottle of a different diameter. As shown in FIG. 15, the upper portion of the interior of the additional generally cylindrical sides 30 can include an interior ridge 38 that improves the leak-tight seal and prevents over tightening of the drinking adapter on the bottle mouth. There can be a perforation 34 between each terrace rim 28 and the generally cylindrical side 16, 30 of the next larger terrace level 32. This allows the user to tear off a smaller terrace level 32 in order to expose a terrace level that fits a larger beverage container (A). As used herein, "perforations" is used to refer to perforations, score lines, or other means providing for easy tearing along a desired path. Particularly where the drinking adapter is formed from a plastic.

Figure 16A:
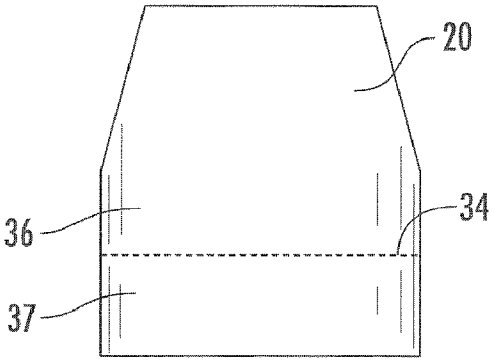
FIG. 16(*a*) is a front view of a drinking adapter with multiple threading sections separated by a horizontal perforation; (*b*) is a side view of the drinking adapter; and (*c*) is a top view of the drinking adapter.
Figure 16C:
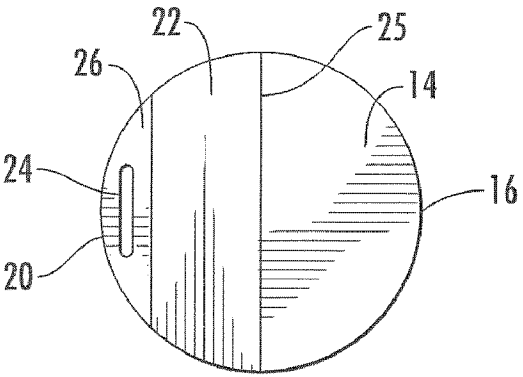
Figure 16B:
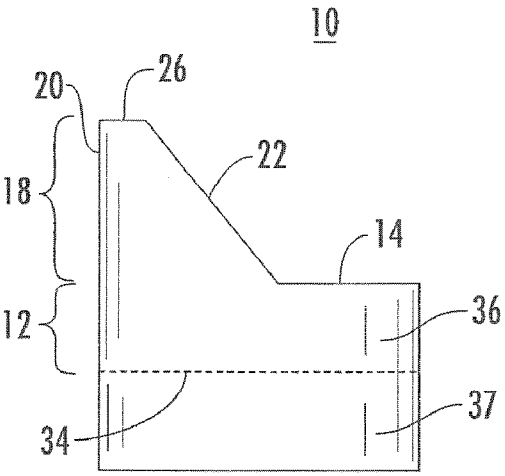

Similarly, where there are multiple different threading patterns for beverage bottles having mouths of the same diameter, the generally cylindrical side 16, 30 can include separate threading sections 36. As shown in FIG. 16, the threading sections 36, 37 can be separated by perforations 34. For example, where a threading section 37 with the wrong threading pattern is at the bottom of the generally cylindrical side 16, 30, that threading section 37 can be removed to expose a second threading section 36 with a different threading pattern, e.g., different pitch, right-handed v. left-handed threads. Each threading section 36, 37 can include an interior ridge 38 that improves the leak-tight seal between the drinking adapter and the bottle mouth.

Figure 6A:
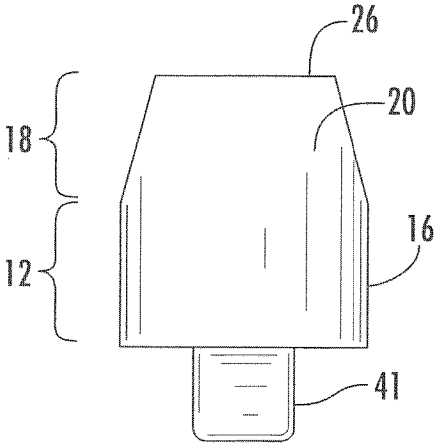
FIG. 6(*a*) is a front view of a drinking adapter that includes a handle with an opening; (*b*) is a side view of the drinking adapter; and (*c*) is a top view of the drinking adapter.
Figure 6C:
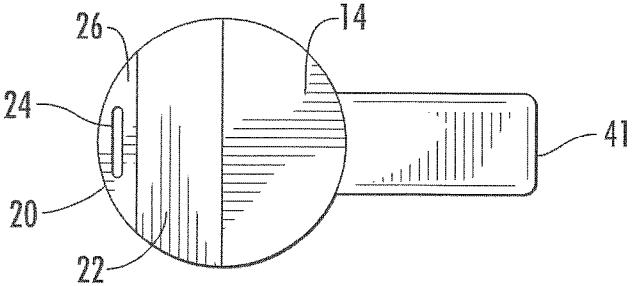
Figure 6B:
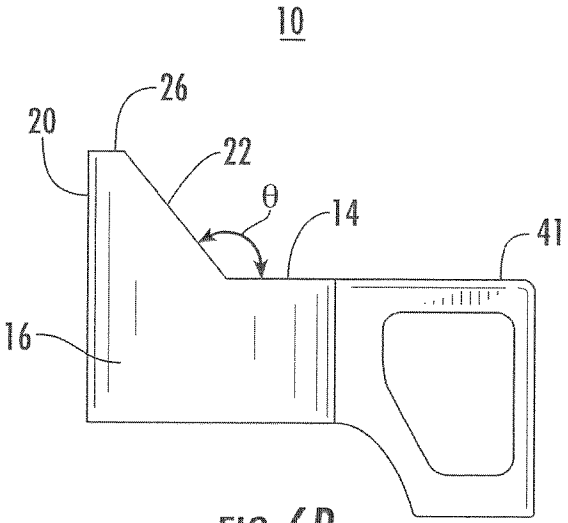
Figure 17:
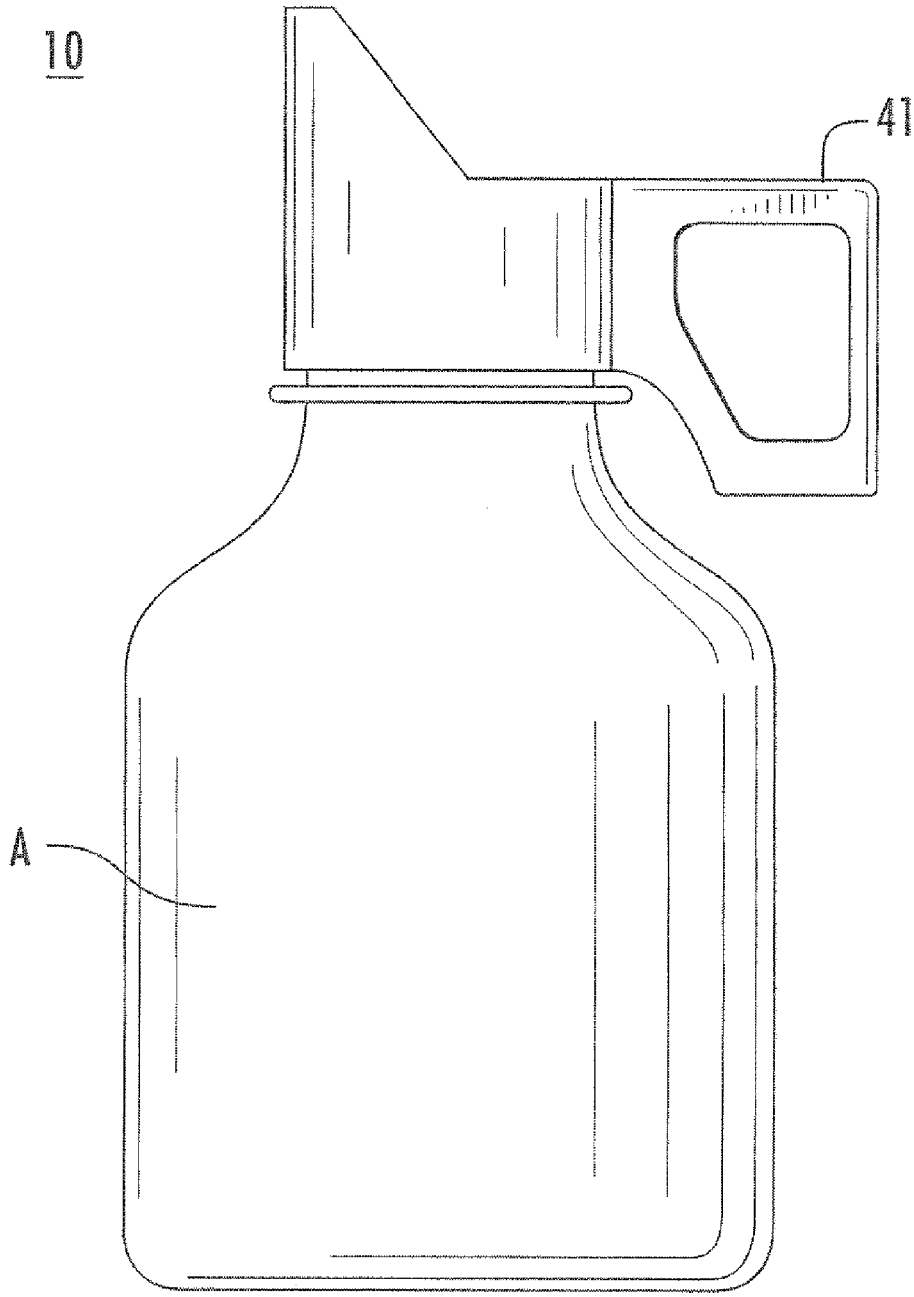
FIG. 17 is a side view of the drinking adapter of FIG. 6 attached to a beverage bottle.

As shown in FIG. 6, the drinking adapter 10 can include a handle 41 extending from the base 12. The handle 41 can extend from the generally cylindrical sides 16. The handle 41 can have the form of a closed loop as shown in FIG. 6, or an open loop (not shown). The handle 41 can make it easier for both the user and the caregiver to carry the drinking adapter 10 alone or the drinking adapter-beverage container combination. FIG. 17 shows how the drinking adapter of FIG. 6 can be attached to a beverage bottle (A).

Figure 4A:
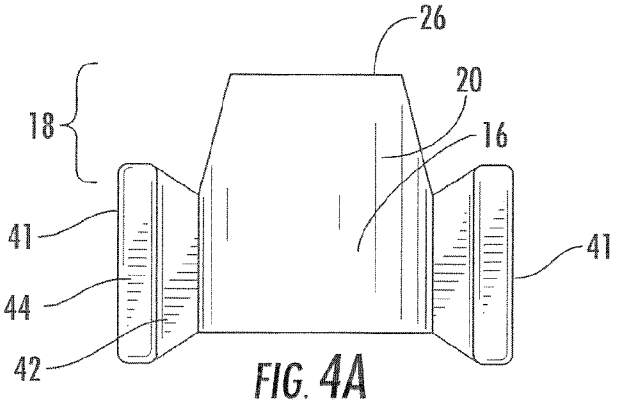
FIG. 4(*a*) is a front view of a drinking adapter that includes two elongated solid handles with a t-shaped cross-section, where a primary axis of the handles is oriented generally vertically; (*b*) is a side view of the drinking adapter; and (*c*) is a top view of the drinking adapter.
Figure 4C:
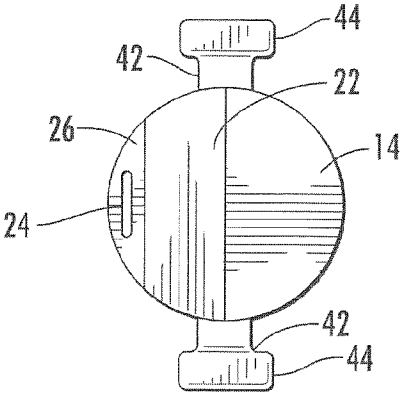
Figure 4B:
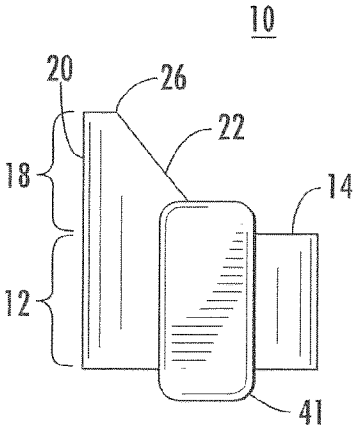
Figure 5A:
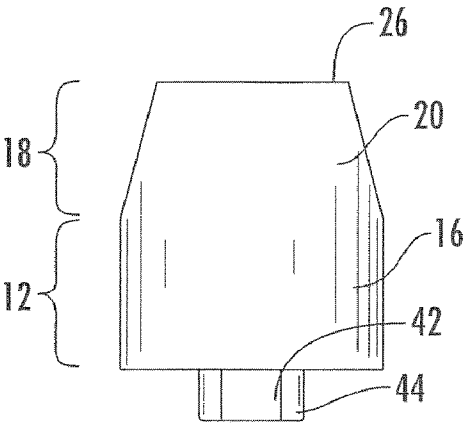
FIG. 5(*a*) is a front view of a drinking adapter that includes one elongated solid handle with a t-shaped cross-section, where a primary axis of the handle is oriented generally vertically; (*b*) is a side view of the drinking adapter; and (*c*) is a top view of the drinking adapter.
Figure 5C:
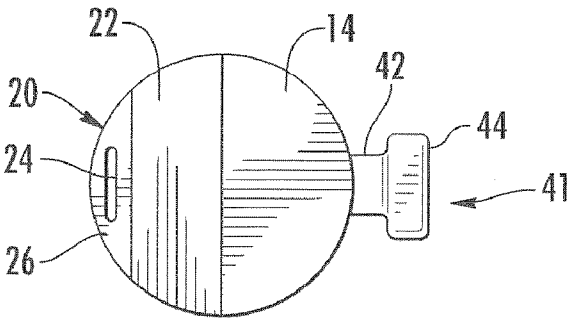
Figure 5B:
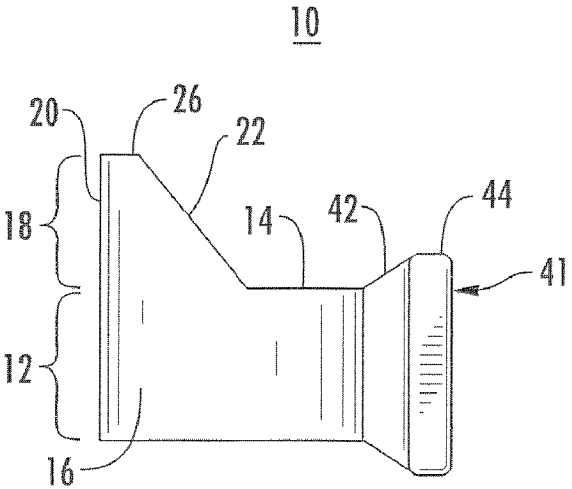

The drinking adapter 10 can include a handle 41 extending from the generally cylindrical sides 16. The handle 41 can be an elongated solid with a T-shaped cross-section, wherein a primary axis of the elongated solid is oriented generally vertically. The handle 41 can be located on a side of the generally cylindrical side 16 opposite the on-demand drinking aperture 24, as shown in FIG. 5. As shown in FIG. 4, the base 42 of the T-shaped cross-section can be designed such that the fingers of the intended user, e.g., an infant or toddler, can fit underneath the top 44 of the T-shaped cross-section.

The drinking adapter 10 can have two handles 41 extending from the generally cylindrical sides 16, where each handle 41 comprises an elongated solid with a T-shaped cross-section and the primary axis of each elongated solid is oriented generally vertically. The handles 41 can be on opposite sides of the drinking adapter 10. As shown in FIG. 4, the handles 41 can be located on the generally cylindrical sides 16 approximately 90 degrees from the center of the on-demand drinking aperture 24.

In general, where there are two handles 41, the handles 41 can be located between about 15 degrees and about 165 degrees from the center of the drinking aperture 24, or between about 30 degrees and about 150 degrees, or from about 45 degrees to about 135 degrees, or any range including a combination of these endpoints, e.g., 15 degrees to 135 degrees.

Figure 7C:
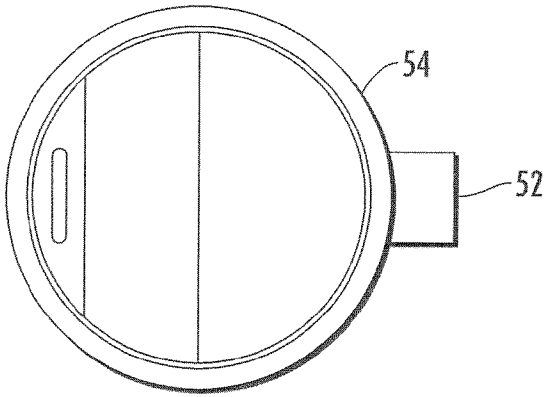
FIG. 7(*a*) is a front view of a drinking adapter with a plug that includes a tether portion and a stopper designed to fit the dimensions of the drinking aperture, where the first end of the tether portion is connected to the base and the stopper is connected to the opposite end of the tether portion ; (*b*) is a side view of the drinking adapter; and (*c*) is a top view of the drinking adapter.
Figure 7A:
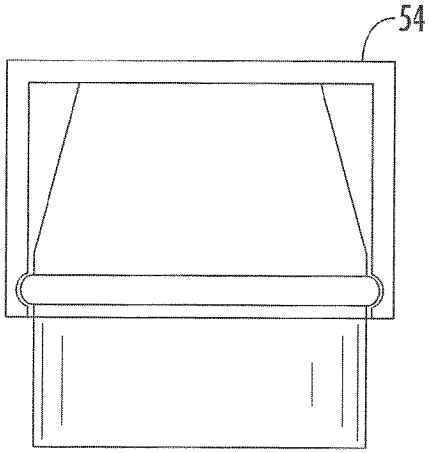
Figure 7B:
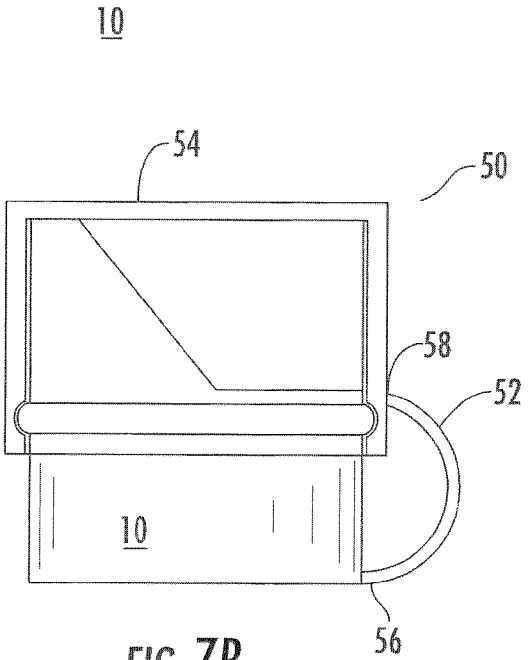
Figure 8A:
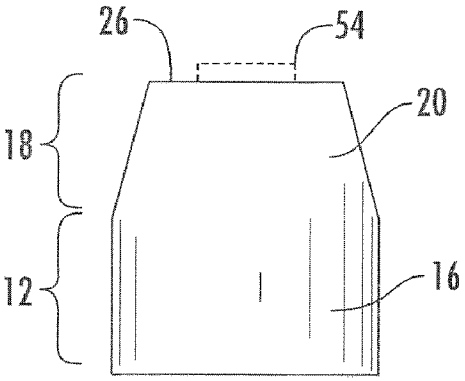
FIG. 8(*a*) is a front view of a drinking adapter with another embodiment of a plug that includes a tether portion and a stopper designed to fit the dimensions of the drinking aperture, where the first end of the tether portion is connected to the base and the stopper is connected to the opposite end of the tether portion; (*b*) is a side view of the drinking adapter; and (*c*) is a top view of the drinking adapter.
Figure 8C:
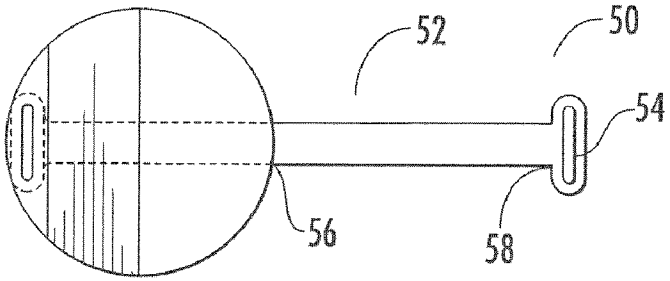
Figure 8B:
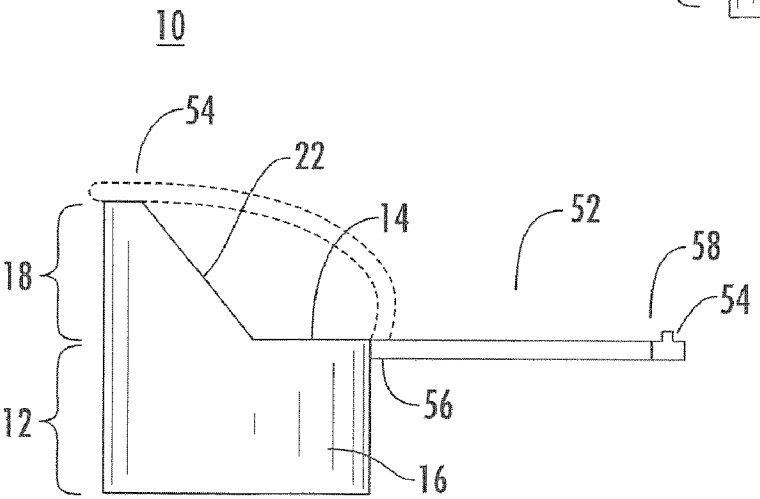

As shown in FIGS. 7 and 8, the drinking adapter 10 can include a plug 50 for the on-demand drinking aperture 41, and the plug 50 can be an integral part of the drinking adapter 10. The plug 50 can include a tether portion 52 and a stopper 54 designed to fit the dimensions of the drinking aperture 24, where the first end 56 of the tether portion is connected to the base 12 and the stopper 54 is connected to the opposite end 58 of the tether portion 52.

Figure 18A:
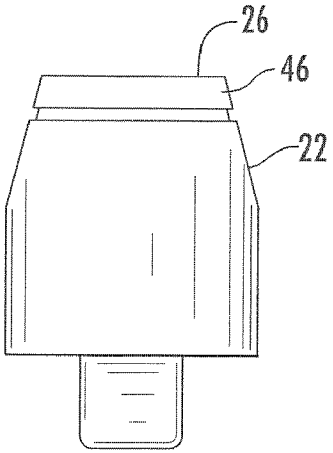
FIG. 18(*a*) is a front view of a pull-top drinking adapter that includes a handle with an opening; (*b*) is a side view of the drinking adapter; and (*c*) is a top view of the drinking adapter.
Figure 18C:
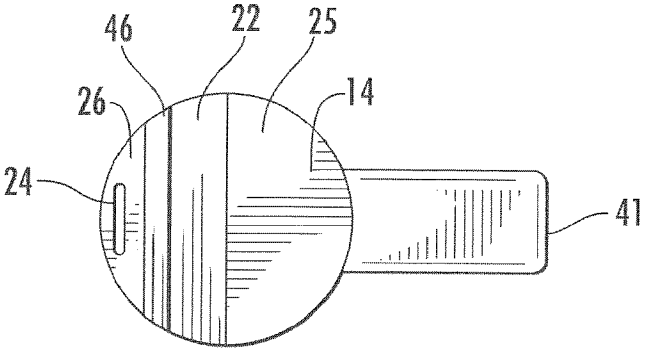
Figure 18B:
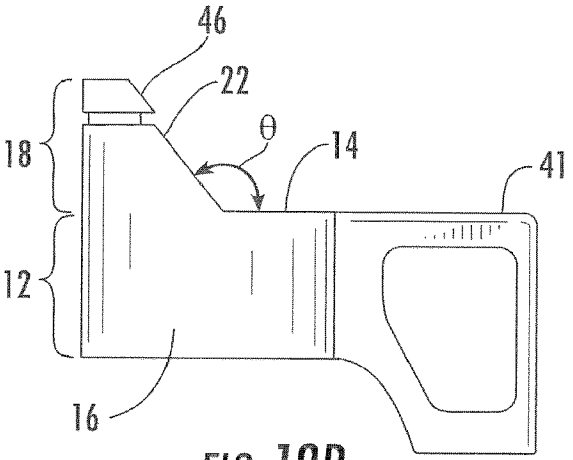

The drinking adapter 10 can be modified to include other mechanisms for controlling fluid flow. For example, as shown in FIG. 18, the on-demand drinking orifice 24 can be part of a pull-top 46 that controls fluid flow. In such an embodiment, the on-demand drinking orifice 24 can be plugged when the pull-top 46 is refracted, but the on-demand drinking orifice 24 can be open for fluid flow when the pull-top 46 is extended, as shown in FIG. 18. Although not shown, a flip top embodiment is also envisioned. A flip top embodiment could be similar to that of FIG. 7, except that the flip top would be hingedly connected to the spout 18 or the base 12.

Figure 21A:
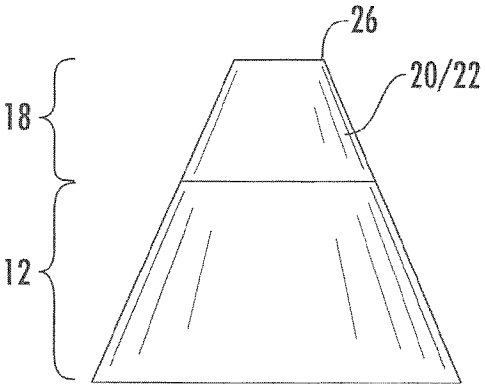
FIG. 21(*a*) is a front view of a drinking adapter where the generally cylindrical sides are conical and the spout is centered over the base of the drinking adapter; (*b*) is a side view of the drinking adapter; and (*c*) is a top view of the drinking adapter.
Figure 21C:
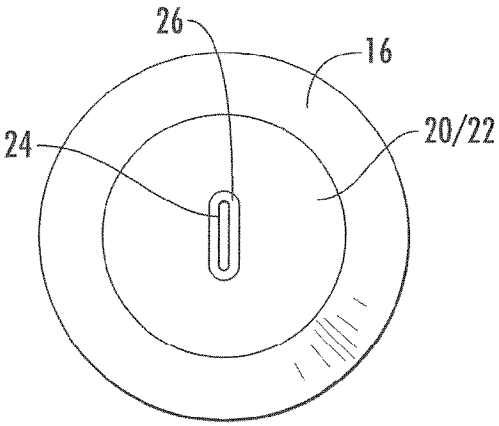
Figure 21B:
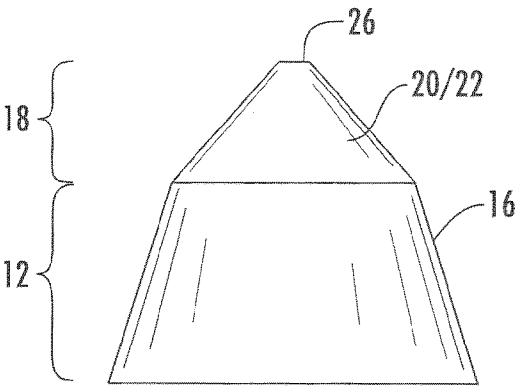

The first vertically extending surface 20 of the spout 18 can be coextensive with at least three-quarters of a diameter of the generally cylindrical sides 16. As shown in FIG. 21A-C, the first vertically extending surface 20 can be coextensive with the entire diameter of the generally cylindrical sides 16 and the upper surface 14 and the second surface 22 can be the same.

In another embodiment, the invention can be a kit that includes a plurality of on-demand drinking adapters 10 for use with a wide variety of beverage containers (A). By including a variety of drinking adapters 10 of varying sizes, it is possible to provide a kit that can be used with substantially all of the common commercial beverage containers (A) that could be handled by individuals in need of the drinking adapters 10.

It is to be understood that while the invention has been described in conjunction with the preferred specific embodiments thereof, that the foregoing description as well as the examples which follow are intended to illustrate and not limit the scope of the invention. Other aspects, advantages and modifications within the scope of the invention will be apparent to those skilled in the art to which the invention pertains.

I claim:

1. An on-demand drinking adapter for use with a beverage container, comprising:

a base comprising an upper surface and generally cylindrical sides extending below the upper surface, wherein the generally cylindrical sides are adapted for temporarily fastening the drinking adapter to a mouth of a beverage container; and a spout comprising a first vertically extending strike, a second surface, and an on-demand drinking aperture, wherein the spout extends above said upper surface, and wherein the first vertically extending surface is curved and coextensive with a portion of the cylindrical sides, wherein the generally cylindrical side comprises a plurality of threading sections separated by perforations, wherein each threading section comprises a different threading pattern.

2. The drinking adapter of claim 1, wherein the on-demand drinking aperture is a slot having a width selected to prevent leakage of fluid from a beverage container when said on-demand drinking adapter is fastened to a beverage container.

3. The drinking adapter of claim 1, wherein the on-demand drinking aperture is defined by the edges of the first vertically extending surface and the second surface.

4. The drinking adapter of claim 1, wherein the spout further comprises a third surface that defines an uppermost portion of the spout, wherein the third surface comprises the on-demand drinking aperture.

5. The drinking adapter of 1, wherein the generally cylindrical sides are conical, with the pitch of the cone selected such that the drinking adapter can be temporarily fastened to beverage containers having mouths of various sizes.

6. The drinking adapter of claim 5, further comprising a compression seal material attached to the interior of the generally cylindrical sides, wherein the compression seal material is an elastomer and has a thickness designed to create a water-tight seal on bottle mouths of various sizes.

7. The drinking adapter of claim 1, further comprising a handle extending from the generally cylindrical sides.

8. The drinking adapter of claim 7, wherein the handle comprises an elongated, solid with a T-shaped cross-section, wherein a primary axis of the elongated solid is oriented generally vertically.

9. The drinking adapter of claim 8, wherein the handle is located on a side of the generally cylindrical side opposite the on-demand drinking aperture.

10. The drinking adapter of claim 1, wherein the on-demand drinking adapter comprises two handles extending from the generally cylindrical sides, wherein each handle comprises an elongated solid with a T-shaped cross-section, wherein a primary axis of each elongated solid is oriented generally vertically.

11. The drinking adapter of claim 1, further comprising a plug for the on-demand drinking aperture, wherein the plug is an integral part of the drinking adapter.

12. The drinking adapter of claim 11, wherein the plug, comprises a tether portion and a stopper designed to fit the dimensions of the thinking aperture, wherein a first end of the tether portion is connected to the base and the stopper is connected to an end of the tether portion opposite the first end.

13. The drinking adapter of claim 1, wherein first vertically extending surface is coextensive with at least three-quarters of a perimeter of the generally cylindrical sides.

14. The drinking adapter of claim 1, wherein the generally cylindrical side is perforated and the drinking adapter is designed to remain on the beverage container until the generally cylindrical side is torn using the perforations.

15. The drinking adapter of claim 1, further comprising a terrace level comprising a second generally cylindrical side and a terrace rim, wherein the terrace rim connects a lower end of the generally cylindrical side to an upper end of the second generally cylindrical side.

16. The drinking adapter of claim 15, wherein the second generally cylindrical side has a smaller diameter than a diameter of the generally cylindrical side.

17. The drinking adapter of claim 15, wherein the second generally cylindrical side has a larger diameter than a diameter of the generally cylindrical side.

18. The drinking adapter of claim 17, wherein an interface between the terrace rim and the generally cylindrical side is perforated or the interface between the terrace rim and the second generally cylindrical side is perforated, or both.

19. The drinking adapter of claim 18, wherein (i) the generally cylindrical side comprises a plurality of threading sections separated by perforations, wherein each threading section having a different threading pattern;

(ii) the second generally cylindrical side comprises a plurality of threading sections separated by perforations, wherein each threading section having a different threading pattern; or (iii) both.

20. An on-demand drinking adapter for use with a beverage container, comprising:

a base comprising an upper surface and generally cylindrical sides extending below the upper surface, wherein the generally cylindrical sides are adapted for temporarily fastening the drinking adapter to a mouth of a beverage container; and a spout comprising a first vertically extending surface, a second surface, and an on-demand drinking aperture, wherein the spout extends above said upper surface, and wherein the first vertically extending surface is curved and coextensive with a portion of the cylindrical sides, further comprising a terrace level comprising a second generally cylindrical side and a terrace rim, wherein the terrace rim connects a lower end of the generally cylindrical side to an upper end of the second generally cylindrical side, and the second generally cylindrical side has a diameter different from the generally cylindrical side, wherein an interface between the terrace rim and the generally cylindrical side is perforated, and wherein (i) the generally cylindrical side comprises a plurality of threading sections separated by perforations wherein each threading section having a different threading pattern;

(ii) the second generally cylindrical side comprises a plurality of threading sections separted by perforations, wherein each threading section having a different threading pattern; or (iii) both.

* * * * *